US007937870B2

(12) United States Patent
Brown

(10) Patent No.: US 7,937,870 B2
(45) Date of Patent: May 10, 2011

(54) FIREARM HAVING A DEBRIS SHIELD FOR USE WITH A DIRECT GAS IMPINGEMENT SYSTEM

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 127 days.

(21) Appl. No.: 12/496,011

(22) Filed: Jul. 1, 2009

(65) Prior Publication Data

US 2011/0067285 A1 Mar. 24, 2011

Related U.S. Application Data

(60) Provisional application No. 61/133,624, filed on Jul. 1, 2008, provisional application No. 61/211,228, filed on Mar. 27, 2009.

(51) Int. Cl.
*F41A 3/00* (2006.01)

(52) U.S. Cl. ..... 42/16

(58) Field of Classification Search ..... 42/16, 71.01; 89/1.4, 191.01, 191.02, 193, 33.02
See application file for complete search history.

(56) References Cited

U.S. PATENT DOCUMENTS

| | | | | |
|---|---|---|---|---|
| 1,379,989 | A | 5/1921 | Johnson | |
| 1,402,459 | A | 1/1922 | Swebilius | |
| 1,846,993 | A | 2/1932 | Destree | |
| 1,878,038 | A | 9/1932 | Von Frommer | |
| 2,341,767 | A | 2/1944 | Gans | |
| 2,462,119 | A | 2/1949 | Moore | |
| 2,685,754 | A | 8/1954 | Crittendon et al. | |
| 2,752,826 | A | 7/1956 | Simpson | |
| 2,775,166 | A | 12/1956 | Janson | |
| 2,780,145 | A | 2/1957 | Saive | |
| 2,783,685 | A | 3/1957 | Green | |
| 2,882,635 | A | 4/1959 | Hill | |
| 2,940,201 | A * | 6/1960 | Reed | 42/16 |
| 2,951,424 | A | 9/1960 | Stoner | |
| 3,176,424 | A | 4/1965 | Hoge | |
| 3,198,076 | A | 8/1965 | Stoner | |

(Continued)

OTHER PUBLICATIONS

Article entitled "M26 Modular Accessory Shotgun System" from Wikipedia, the free encyclopdia dated Jun. 2008; http://en.wikipedia.org/wiki/M26_Modular_Accessory_Shotgun_System.

(Continued)

*Primary Examiner* — Troy Chambers
(74) *Attorney, Agent, or Firm* — Howard & Howard Attorneys PLLC

(57) ABSTRACT

A firearm having a receiver defining a bore with the receiver extending along a longitudinal axis. The receiver defines an ejection port transverse to the longitudinal axis with the bore defining an inner surface. A bolt carrier is disposed in the bore and moves relative to the receiver along the longitudinal axis between a firing position and a rearward position with the bolt carrier defining at least one exhaust port transverse to the longitudinal axis. A shield defines an aperture aligned with the exhaust port for exhausting gases therethrough. The shield is longitudinally affixed to the bolt carrier and moves with the bolt carrier as a unit between the firing and rearward positions along the longitudinal axis with the shield blocking the ejection port when in the firing position and the shield sliding along the inner surface away from the ejection port when moving to the rearward position in conjunction with the bolt carrier.

13 Claims, 7 Drawing Sheets

U.S. PATENT DOCUMENTS 3,236,155 A 2/1966 Sturtevant
3,255,667 A 6/1966 Walther
3,300,889 A 1/1967 Baker
3,368,298 A 2/1968 Browning
3,397,473 A 8/1968 Browning
3,405,470 A 10/1968 Wesemann
3,592,101 A 7/1971 Vartanian et al.
3,618,457 A 11/1971 Miller
3,619,926 A 11/1971 Alday
3,675,534 A 7/1972 Beretta
3,686,998 A 8/1972 Seifried
3,742,636 A 7/1973 Dealy et al.
3,771,415 A 11/1973 Into et al.
3,774,498 A 11/1973 Moller et al.
3,776,095 A 12/1973 Atchisson
3,938,271 A 2/1976 Hyytinen
3,938,422 A 2/1976 Tellie
3,960,053 A 6/1976 Conley
3,969,980 A 7/1976 Brandstatter et al.
3,999,461 A 12/1976 Johnson et al.
4,020,741 A 5/1977 Junker
4,044,487 A 8/1977 Hutton et al.
4,088,057 A 5/1978 Nasypany
4,125,054 A 11/1978 Jennie
4,244,273 A 1/1981 Langendorfer, Jr. et al.
4,246,830 A 1/1981 Krieger
4,358,986 A 11/1982 Giorgio
4,389,920 A 6/1983 Dufour, Sr.
4,398,448 A 8/1983 LaFever
4,443,962 A * 4/1984 Bernet et al. ..... 42/16
4,505,182 A 3/1985 Sullivan
4,553,469 A 11/1985 Atchisson
4,654,993 A 4/1987 Atchisson
4,663,875 A 5/1987 Tatro
4,689,911 A 9/1987 White
4,693,170 A 9/1987 Atchisson
4,703,826 A 11/1987 Byron
4,756,228 A 7/1988 Roth
4,765,224 A 8/1988 Morris
4,766,800 A 8/1988 Miller et al.
4,867,039 A 9/1989 Dobbins
4,893,547 A 1/1990 Atchisson
4,972,617 A 11/1990 Major
5,198,600 A 3/1993 E'Nama
5,343,650 A 9/1994 Swan
5,351,598 A 10/1994 Schuetz
5,540,008 A 7/1996 Kirnstatter
5,821,445 A 10/1998 Guhring
5,824,923 A 10/1998 Kondoh et al.
5,827,992 A 10/1998 Harris et al.
5,918,401 A 7/1999 Rowlands
5,945,626 A 8/1999 Robbins
6,019,024 A 2/2000 Robinson et al.
6,134,823 A 10/2000 Griffin
6,311,603 B1 11/2001 Dunlap
6,418,655 B1 7/2002 Kay
6,453,594 B1 9/2002 Griffin
6,481,145 B2 11/2002 Weichert et al.
6,499,246 B1 12/2002 Zedrosser
6,564,491 B2 5/2003 Murello
6,609,321 B2 8/2003 Faifer
6,619,592 B2 9/2003 Vignaroli et al.
6,625,916 B1 9/2003 Dionne
6,634,274 B1 10/2003 Herring
6,722,255 B2 4/2004 Herring
6,732,466 B2 5/2004 Bentley
6,782,791 B2 8/2004 Moore
6,829,858 B2 12/2004 Gablowski
6,848,351 B1 2/2005 Davies
7,000,345 B1 2/2006 Kay
7,131,228 B2 11/2006 Hochstrate et al.
RE39,465 E 1/2007 Swan
7,231,861 B1 6/2007 Gauny et al.
7,418,898 B1 9/2008 Desomma
7,448,307 B1 11/2008 Dafinov
7,461,581 B2 12/2008 Leitner-Wise
7,469,624 B1 12/2008 Adams
7,478,495 B1 1/2009 Alzamora et al.
2003/0074822 A1 4/2003 Faifer
2005/0115134 A1 6/2005 Bond et al.
2005/0115398 A1 6/2005 Olson
2005/0262752 A1 12/2005 Robinson et al.
2006/0065112 A1 3/2006 Kuczynko et al.
2006/0156606 A1 7/2006 Robinson et al.
2006/0236582 A1 10/2006 Lewis et al.
2006/0254112 A1 11/2006 Snoderly
2007/0033851 A1 2/2007 Hochstrate et al.
2007/0199435 A1 8/2007 Hochstrate et al.
2008/0110074 A1 5/2008 Bucholtz et al.
2009/0000173 A1 1/2009 Robinson et al.
2009/0007477 A1 1/2009 Robinson et al.
2009/0031605 A1 2/2009 Robinson
2009/0031606 A1 2/2009 Robinson et al.
2009/0031607 A1 2/2009 Robinson et al.
2009/0249673 A1 * 10/2009 Zedrosser ..... 42/16

OTHER PUBLICATIONS

Article entitled "The USA's M4 Carbine Controversy" dated Feb. 2, 2009, www.defenseindustrydaily.com/the-usas-m4-carbine-controversy-03289/.

Article entitled "M4 Carbine Review" dated May 2, 2007; http://home.comcast.net/ shooter2_indy/m4.html.

Article entitled "Critics Turn Crosshairs on Military's Main Rifle" dated Apr. 20, 2008 from the website "USA Today"; www.usatoday.com/news/military/2008-04-20-gunwars_N.htm.

Parts Schematic entitled "Schematic for Bushmaster M4A3 Carbine" from the website "Bushmaster" dated Jun. 2008; www.bushmaster.com/electronic-documents/operation-manual/opmanual.pdf.

Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-and-video/.

Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.

Article entitled "M16 rifle" from Wikipedia, the free encyclopedia dated Jun. 2008; http://en.wikipedia.org/wiki/M-16_rifle.

Article entitled "M4 Carbine" from Wikipedia, the free encyclopedia dated Jun. 2008; http://en.wikipedia.org/wiki/M4_carbine.

Animation entitled "How an AR15 Works" from the website dated Jun. 2008; www.barnesengineering.com/AR15animation/index.htm.

* cited by examiner

FIREARM HAVING A DEBRIS SHIELD FOR USE WITH A DIRECT GAS IMPINGEMENT SYSTEM

CROSS REFERENCE TO RELATED APPLICATIONS

The subject patent application claims priority to and the benefits of U.S. Provisional Patent Application Ser. No. 61/133,624, filed on Jul. 1, 2008 and U.S. Provisional Patent Application Ser. No. 61/211,228, filed on Mar. 27, 2009.

BACKGROUND OF THE INVENTION

1. Field of the Invention

The subject invention relates to firearms and more specifically to mechanisms that minimize fouling of firing components.

2. Description of the Prior Art

Firearms typically include a receiver that houses several working components of the firearm, including firing components, with a barrel extending from the receiver. There are various classes of firearms that operate in different manners. One class of firearm utilizes a bolt carrier disposed in the receiver that is moveable between a firing position, from which a live round of ammunition can be fired, and a retracted position, from which a spent casing is ejected. The movement of the bolt carrier and ejection of the casing can be accomplished with a direct gas impingement system. Examples of direct gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward a retracted position. In particular, after firing the firearm, the direct gas impingement system routes exhaust gases, including any associated debris, from the barrel, back through a return tube to the bolt carrier, and out the ejection port of the receiver.

Some firearms include an ejection port door for covering the ejection port to prevent debris from entering the receiver and fouling the firing components. The ejection port door automatically opens in response to firing the firearm and/or charging the firearm, i.e. loading a live round into a chamber of the barrel. However, the ejection port door must be manually moved to the closed position by a user to prevent debris from entering the ejection port and thus entering the receiver. Accordingly, during combat it is unlikely the user will consistently close the ejection port door after firing or charging the firearm, thereby allowing debris to foul the firing components and potentially cause the firearm to jam or fail.

The prior art has attempted to solve the problem of debris entering the ejection port. For example, U.S. Pat. No. 3,619,926 to Alday discloses a firearm having a receiver defining an ejection port window with a bolt assembly movably disposed within the receiver. The firearm further includes a cover plate coupled to the bolt assembly with the cover plate movable independently to the bolt assembly. Having the cover plate and the bolt assembly moving independently of each other in such a manner increases frictional wear between the components and thus increases the possibility of the cover plate and/or the bolt assembly failing. In addition, the system disclosed in Alday is relatively complicated and has additional moving parts that are prone to failure.

Therefore, there remains a need to develop a firearm having a mechanism that automatically blocks an ejection port when in a firing position and minimizes, if not eliminates, fouling of the firing components.

SUMMARY OF THE INVENTION AND ADVANTAGES

The present invention provides for a firearm having a receiver defining a bore with the receiver extending along a longitudinal axis. The receiver defines an ejection port transverse to the longitudinal axis with the bore defining an inner surface. A bolt carrier is disposed in the bore and moveable relative to the receiver along the longitudinal axis between a firing position and a rearward position with the bolt carrier defining at least one exhaust port transverse to the longitudinal axis. A shield defines an aperture aligned with the exhaust port for exhausting gases therethrough. The shield is longitudinally affixed to the bolt carrier and moves with the bolt carrier as a unit between the firing and rearward positions along the longitudinal axis with the shield blocking the ejection port when in the firing position and the shield sliding along the inner surface away from the ejection port when moving to the rearward position in conjunction with the bolt carrier.

Accordingly, the present invention defines a mechanism, in the form of a shield or a shield apparatus, that minimizes, if not eliminates, fouling of the firing components, i.e. the action. In particular, the shield is longitudinally affixed to the bolt carrier to provide automatic blocking of an ejection port anytime the bolt carrier is in a firing position without having to manually close a door for preventing debris from entering the ejection port and fouling the firing components.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
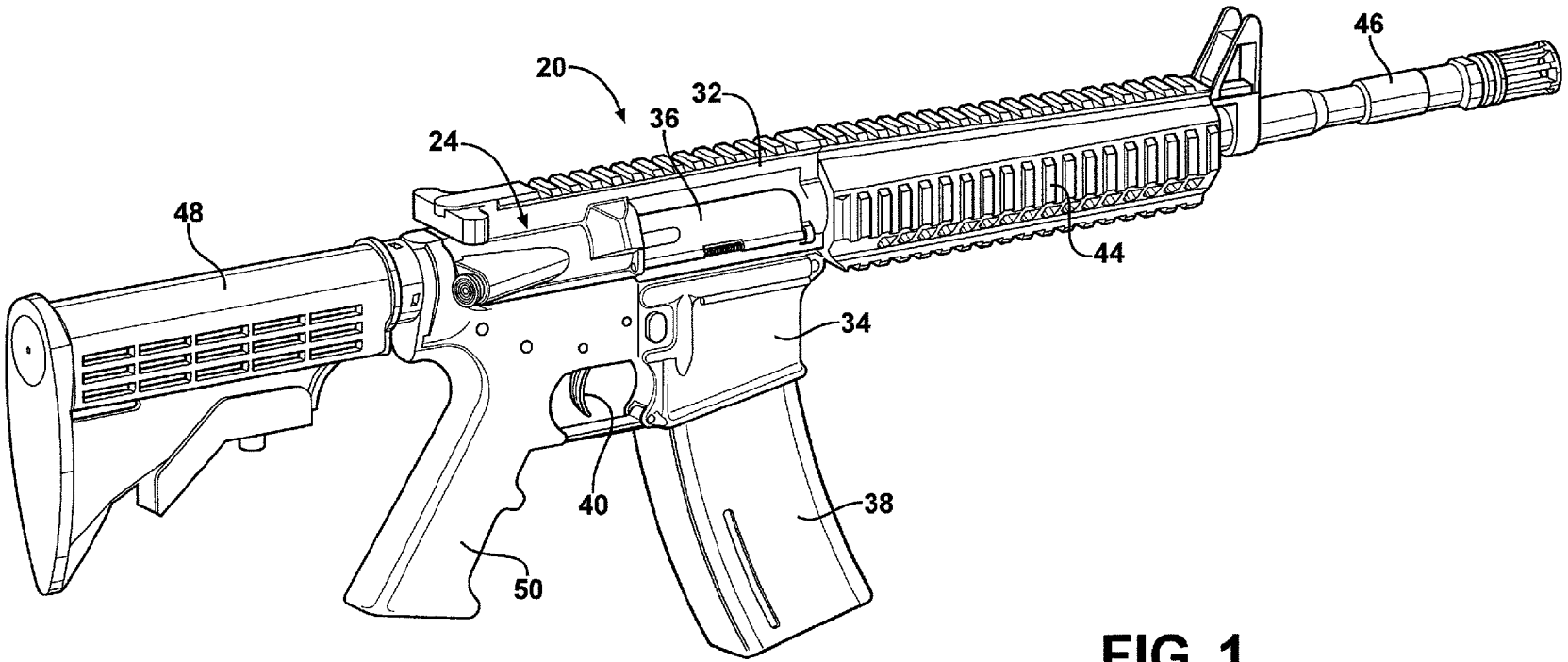
FIG. 1 is a perspective view of a firearm in accordance with the subject invention.
Figure 2:
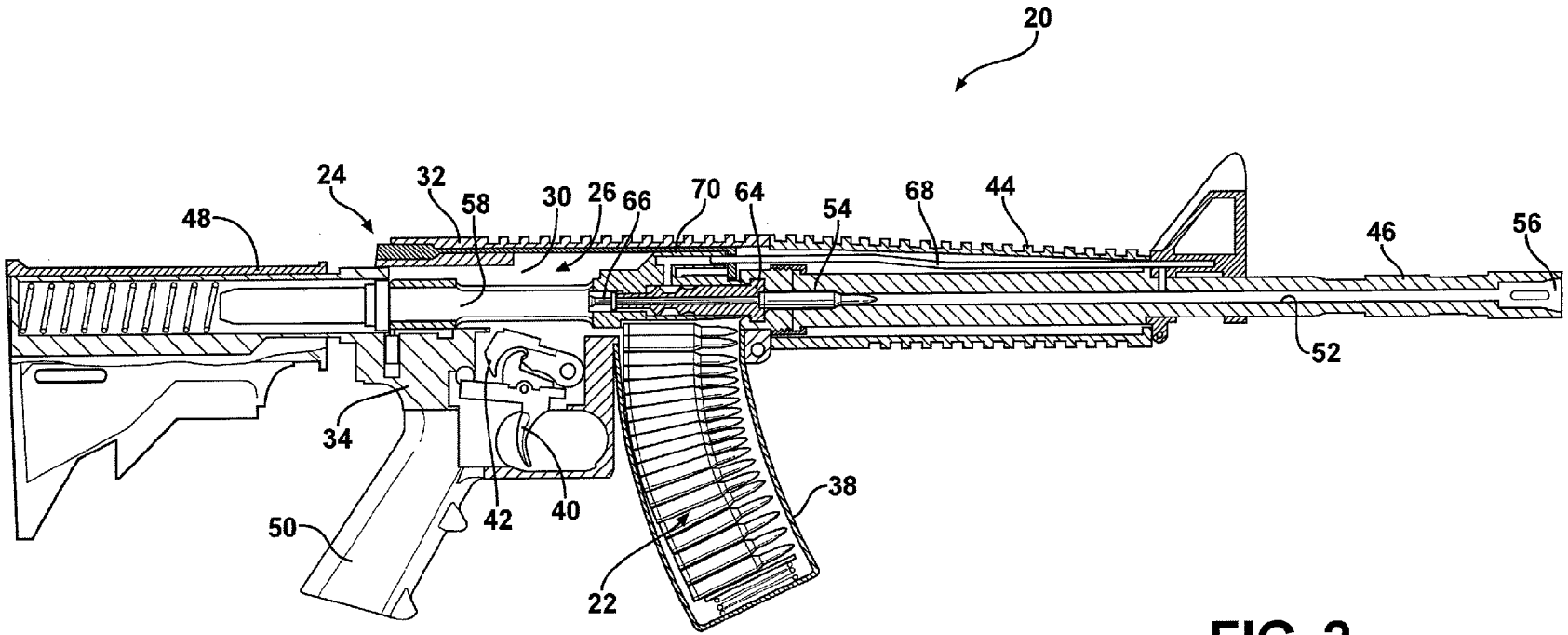
FIG. 2 is a partial cross-sectional side view of the firearm.

Referring to the Figures, wherein like numerals indicate like or corresponding parts throughout the several views, a firearm 20 is generally shown in FIGS. 1 and 2. The firearm 20 receives and fires a live round of ammunition 22 (hereinafter "live round"), also referred to as a cartridge, which includes a casing, a bullet, and other components to propel the bullet as known to those skilled in the art.

The firearm 20 utilizes a direct gas impingement system to eject a spent casing after firing the firearm 20. Examples of such types of firearms 20 include the M16, the M4®, such as the M4® carbine, and the AR-15®, such as the AR-15® Platform. The firearm 20 described herein is designed to permit easy retro-fitting of the certain components to a variety of currently and/or previously manufactured firearm designs having direct gas impingement systems.

Figure 3:
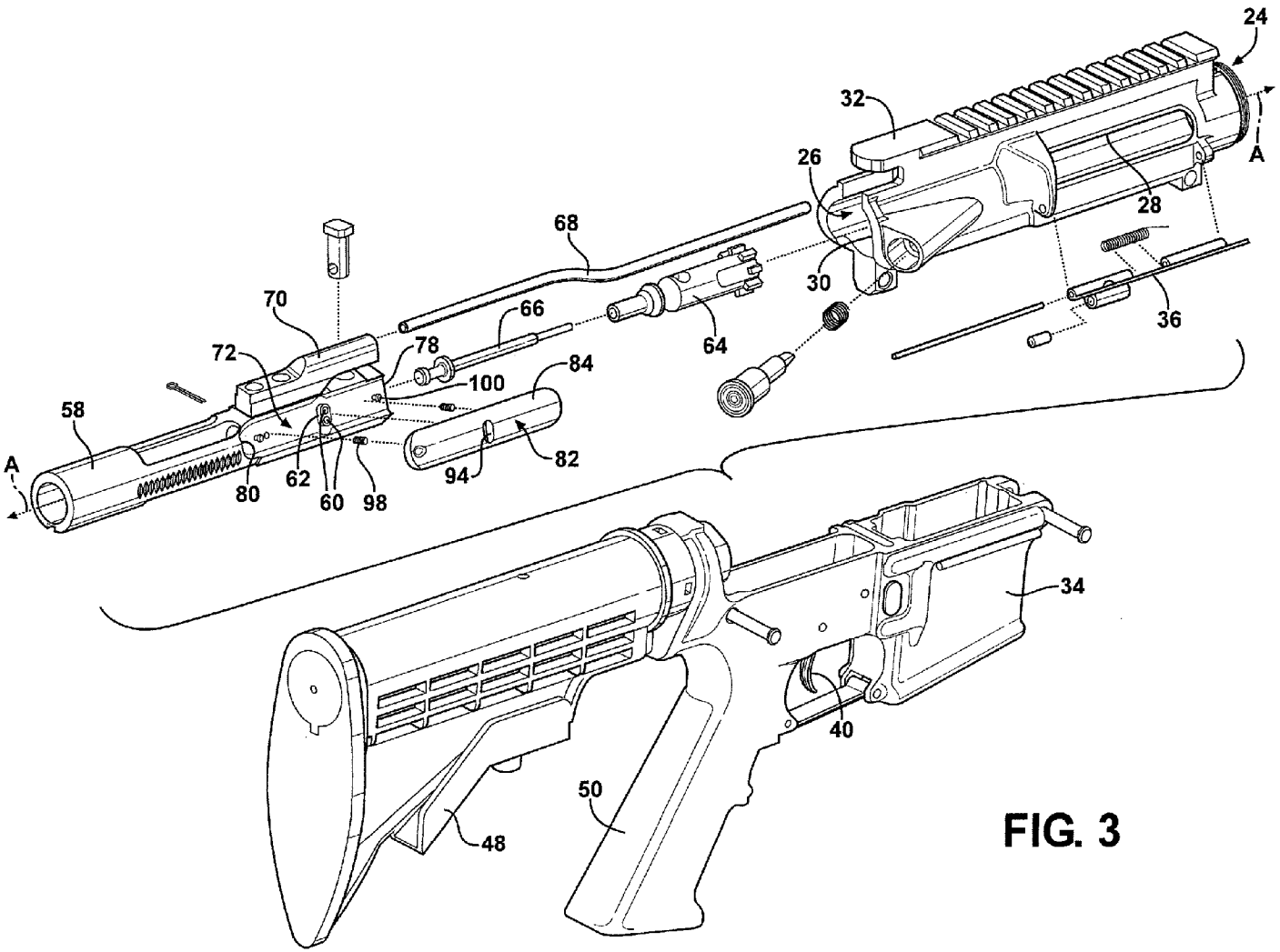
FIG. 3 is an exploded perspective view of a receiver, bolt carrier, bolt and a buttstock.

Referring also to FIG. 3, the firearm 20 includes a receiver 24 defining a bore 26 with the receiver 24 extending along a longitudinal axis L. The receiver 24 houses several working components of the firearm 20, such as the firing components, i.e. the action. The bore 26 of the receiver 24 will be referred to as a first bore 26 throughout this description. As used herein, the phrase "along the longitudinal axis" includes components and/or movements aligning with the longitudinal axis L and/or spaced from and substantially parallel to the longitudinal axis L. The receiver 24 defines an ejection port 28 transverse to the longitudinal axis L with the first bore 26 defining an inner surface 30. As known in the art, the receiver 24 is often divided into an upper receiver portion 32 and a lower receiver portion 34 attached to the upper receiver portion 32. In this configuration, the upper receiver portion 32 defines the first bore 26 and the ejection port 28.

A door 36 is pivotally coupled to the receiver 24 adjacent the ejection port 28. The door 36 is movable between a closed position covering the ejection port 28, a released position allowing the door 36 to move away from the ejection port 28 and an open position completely spaced from the ejection port 28. The closed position is shown in FIG. 1 and the open position is shown in FIG. 5. For illustrative purposes, the door 36 is removed from the receiver 24 in FIG. 4. The door 36 preferably includes a latch selectively engaging the receiver 24 for maintaining the door 36 in the closed position.

A magazine 38, also referred to as a clip, is detachably mounted to the upper receiver portion 34 and can be loaded with a plurality of live rounds. The firearm 20 further includes a trigger assembly supported by the receiver 24. The trigger assembly includes a trigger 40 and a hammer 42. The trigger 40 is pulled to move the hammer 42, which, as discussed further below, ultimately results in the firing of the firearm 20.

The firearm 20 includes a hand guard 44 that extends from the receiver 24 circumferentially about a barrel 46. A buttstock 48 extends rearwardly from the receiver 24 for supporting the firearm 20 against a shoulder of the user. A hand grip 50 extends downwardly along the upper receiver portion 32 for grasping by the user.

As shown in FIG. 2, the barrel 46 is coupled to the receiver 24 and defines a second bore 52 extending along the longitudinal axis L. The barrel 46 includes a breech 54 adjacent the receiver 24 and a muzzle 56 spaced from the breech 54 along the longitudinal axis L with the breech 54 defining a chamber extending along the longitudinal axis L for receiving one of the live rounds. The live rounds are individually loaded into the chamber from the magazine 38. The chamber aligns with the second bore 52 such that the bullet moves out of the chamber and the second bore 52 when firing the firearm 20.

Figure 8:
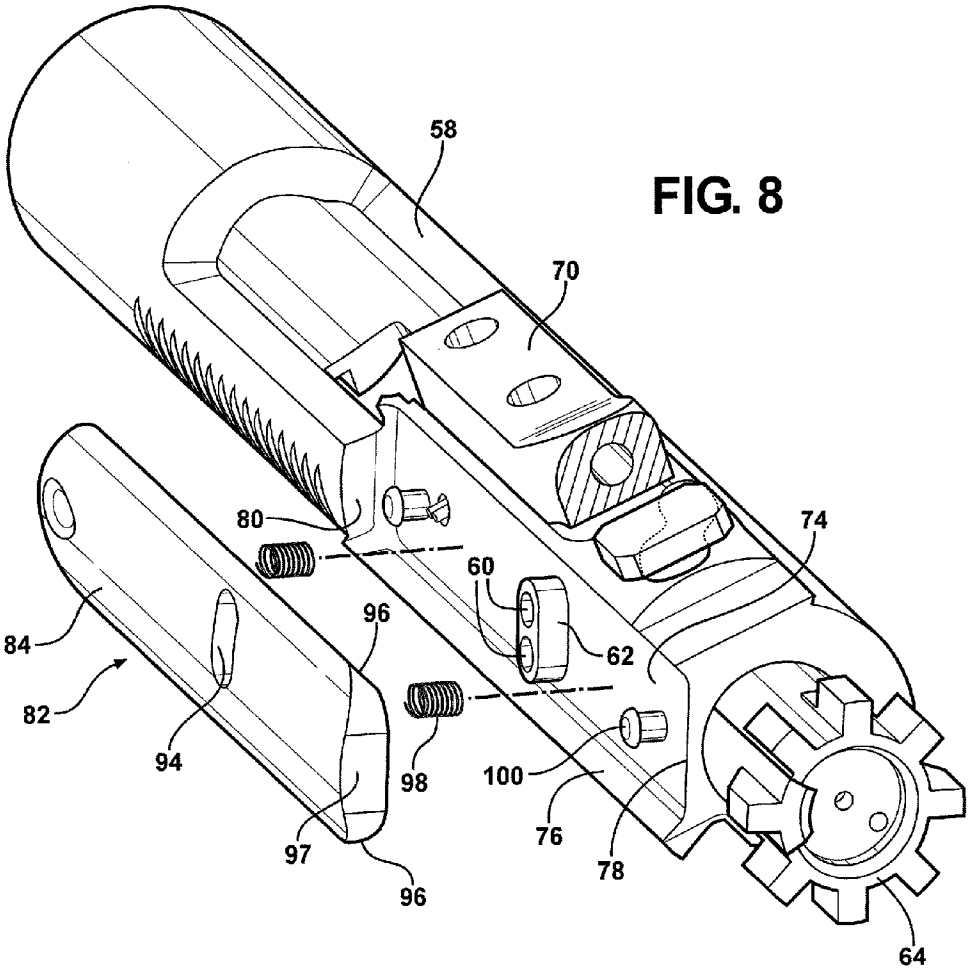
FIG. 8 is an exploded perspective view of the bolt carrier and a shield.

Referring to FIGS. 2-5, a bolt carrier 58 is disposed in the bore 26 of the receiver 24. The bolt carrier 58 is moveable relative to the receiver 24 along the longitudinal axis L between a firing position (FIGS. 2 and 4) and a rearward position (FIG. 5). The bolt carrier 58 defines at least one exhaust port 60 extending transverse to the longitudinal axis L. Preferably there are a plurality of exhaust ports 60 spaced from each other and more preferably there are two exhaust ports 60. As also shown in FIGS. 6 and 8, the bolt carrier 58 further includes a boss 62 defining a portion of the exhaust port 60. Preferably, the boss 62 defines a portion of the plurality of exhaust ports 60 for exhausting gasses therethrough. Even more preferably, the boss 62 includes two exhaust port extensions, which form part of the exhaust ports 60.

As best shown in FIGS. 2 and 3, a bolt 64 and a firing pin 66 are carried by the bolt carrier 58. The bolt carrier 58 typically has features for automatically releasing another live round from the magazine 38 into the chamber as the bolt carrier 58 moves toward the firing position. As the bolt carrier 58 moves from the rearward position toward the firing position, the bolt carrier 58 catches or pushes another live round into the chamber of the barrel 46. In the firing position, the bolt 64 locks to the breech 54 of the barrel 46 to hold the live round in the chamber. The firing components can include the bolt carrier 58, the bolt 64, the firing pin 66, the trigger 40, and the hammer 42 and other components as known to those of skilled in the art.

When the bolt carrier 58 is in the firing position, the trigger 40 can be pulled to release the hammer 42, which strikes the firing pin 66. When the hammer 42 strikes the firing pin 66, the firing pin 66 strikes the live round to fire the live round, which causes the bullet to move through and out of the second bore 52. After firing the live round, the exhaust gases are routed back to the bolt carrier 58 through a return tube 68, which is shown in FIGS. 2 and 3. The exhaust gases enter a carrier key 70 mounted to the bolt carrier 58 and are then routed through the bolt carrier 58 and out the exhaust ports 60. The force of the exhaust gases pushes the carrier key 70 and the bolt carrier 58 toward the rearward position. During the movement of the carrier key 70 and bolt carrier 58, the carrier key 70 separates from the return tube 68. As the bolt carrier 58 moves toward the rearward position, the casing, which is now empty, is expelled from the receiver 24 through the ejection port 28. The return routing of the exhaust gases is known as the direct gas impingement system. The bolt carrier 58 then automatically returns to the firing position and automatically loads another live round from the magazine 38 into the chamber.

Turning to FIGS. 6 and 8, the bolt carrier 58 defines a bolt carrier recess 72 having an outer surface 74 with the outer surface 74 including a distal rim 76 extending angularly away from the longitudinal axis L. The distal rim 76 extends partially around the outer surface 74 of the bolt carrier recess 72. More specifically, the bolt carrier 58 includes a first end 78 and a second end 80 spaced from each other with the bolt carrier recess 72 abutting the first end 78 and the distal rim 76 extending away from the first end 78 along the longitudinal axis L.

Figure 9:
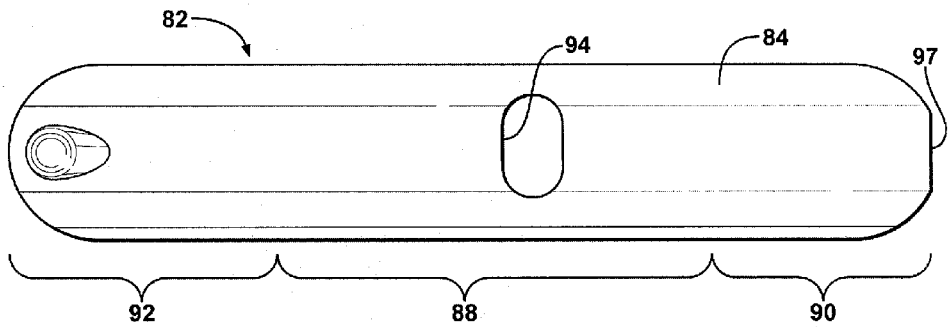
FIG. 9 is a plan view of an exterior side of the shield.
Figure 10:
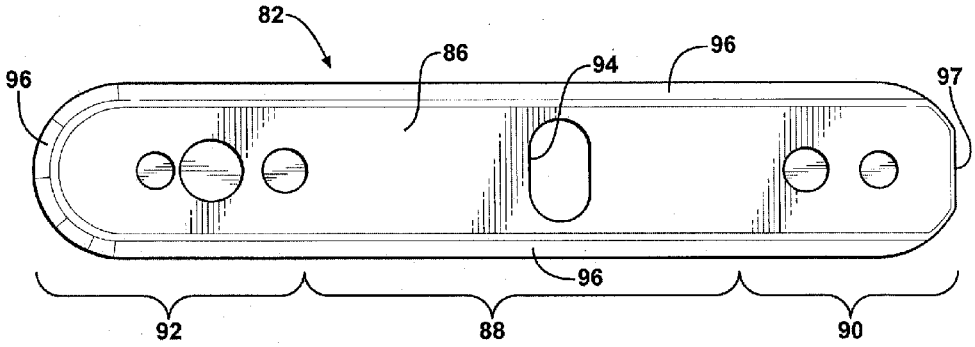
FIG. 10 is a plan view of an interior side of the shield.
Figure 7:
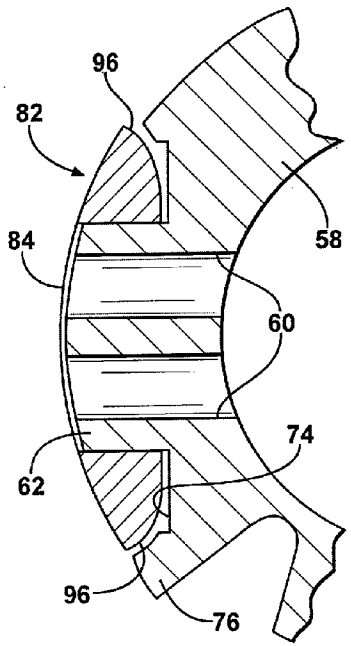
FIG. 7 is a fragmented cross-sectional view of the bolt carrier and shield taken along line 7-7 of FIG. 6.

As also shown in FIGS. 7 and 9-10, the firearm 20 further includes a shield 82 longitudinally affixed to the bolt carrier 58 and moving with the bolt carrier 58 as a unit between the firing and rearward positions along the longitudinal axis L. In other words, the shield 82 and the bolt carrier 58 fail to move independently of each other along the longitudinal axis L. The bolt carrier 58 and the shield 82 can also be removed from the first bore 26 of the receiver 24 as the unit for providing easy cleaning and/or replacement of the components of the firearm 20.

The shield 82 is formed of a self lubricating polymeric material and more specifically formed of a thermoplastic material, such as an acetyl polymer. Other suitable plastics include nylon 12, such as Lauramid® and Nyaltron®; polyoxymethylene; phenolic composites; or combinations thereof. Preferably, the self lubricating polymeric material is formed of Delrin® AF, which comprises an acetyl homopolymer having a polytetrafluoroethylene filler, e.g. PTFE fibers. It is to be appreciated that other polymeric materials can also be used to form the shield 82.

As best shown in FIGS. 9 and 10, the shield 82 includes an exterior side 84 and an interior side 86 spaced from each other and more specifically, the shield 82 is further defined as a body. The interior side 86 of the shield 82 faces the outer surface 74 of the bolt carrier recess 72 and the exterior side 84 of the shield 82 faces the inner surface 30 of the receiver 24. The bolt carrier 58 defines the bolt carrier recess 72 for receiving the shield 82.

The shield 82 further includes a middle portion 88, a first end portion 90 and a second end portion 92. The first 90 and second 92 end portions extend outwardly from the middle portion 88 away from each other. In other words, the middle portion 88 is disposed between the first 90 and second 92 end portions.

The shield 82 defines an aperture 94 aligned with the exhaust port 60 for exhausting gases therethrough. Preferably, the middle portion 88 of the shield 82 defines the aperture 94 with the aperture 94 extending through the entire shield 82. There may also be other apertures or recesses disposed in the shield 82 as needed.

The shield 82 further includes an outer edge and an angled portion 96 tapering toward the outer edge along a part of the shield 82 with the distal rim 76 of the outer surface 74 and the angled portion 96 being complementary in configuration to each other. More specifically, the angled portion 96 is disposed on the interior side 86. The angled portion 96 tapers toward the outer edge along the middle portion 88 and the second end portion 92 with the angled portion 96 tapering toward the outer edge along a section of the first end portion 90. The outer edge includes a flat end 97 along the first end portion 90 with the flat end 97 terminating at the angled portion 96. The flat end 97 of the shield 82 is complementary with the first end 78 of the bolt carrier 58 for preventing the shield 82 from interfering with the operation of the bolt carrier 58 or any other interference with other components of the firearm 20.

A biasing device 98 is disposed between the bolt carrier 58 and the shield 82 for biasing the shield 82 outwardly away from the bolt carrier 58 such that the shield 82 continuously engages the inner surface 30 of the receiver 24 during movement in the firing and rearward positions. The biasing device 98 preferably includes at least one spring 98 disposed between the bolt carrier 58 and the shield 82 for biasing the shield 82 outwardly away from the bolt carrier 58 transverse to the longitudinal axis L. The interior side 86 of the shield 82 can abut the outer surface 74 of the bolt carrier 58 or can be spaced from the outer surface 74 as long as the exterior side 84 remains in engagement with the inner surface 30 of the receiver 24.

A securing system 100 is attached to one of the bolt carrier 58 and the shield 82 for longitudinally affixing the shield 82 to the bolt carrier 58. In other words, the securing system 100 prevents the shield 82 from moving independently of the bolt carrier 58 along the longitudinal axis L while permitting the shield 82 to move independently of the bolt carrier 58 transverse to the longitudinal axis L. Stated another way, the shield 82 is longitudinally affixed to the bolt carrier 58 in such a manner as to allow the shield 82 to move closer to and farther away from the outer surface 74 during biasing movement.

The securing system 100 includes the boss 62 extending outwardly from the outer surface 74 of the bolt carrier 58. Preferably, the boss 62 is received into the aperture 94 of the middle portion 88 for longitudinally affixing the shield 82 to the bolt carrier 58. The boss 62 extends outwardly from the outer surface 74 by a first distance. The exterior side 84 of the shield 82 is disposed a second distance from the outer surface 74. The second distance is greater than the first distance such that the shield 82 extends beyond the boss 62.

Figure 4:
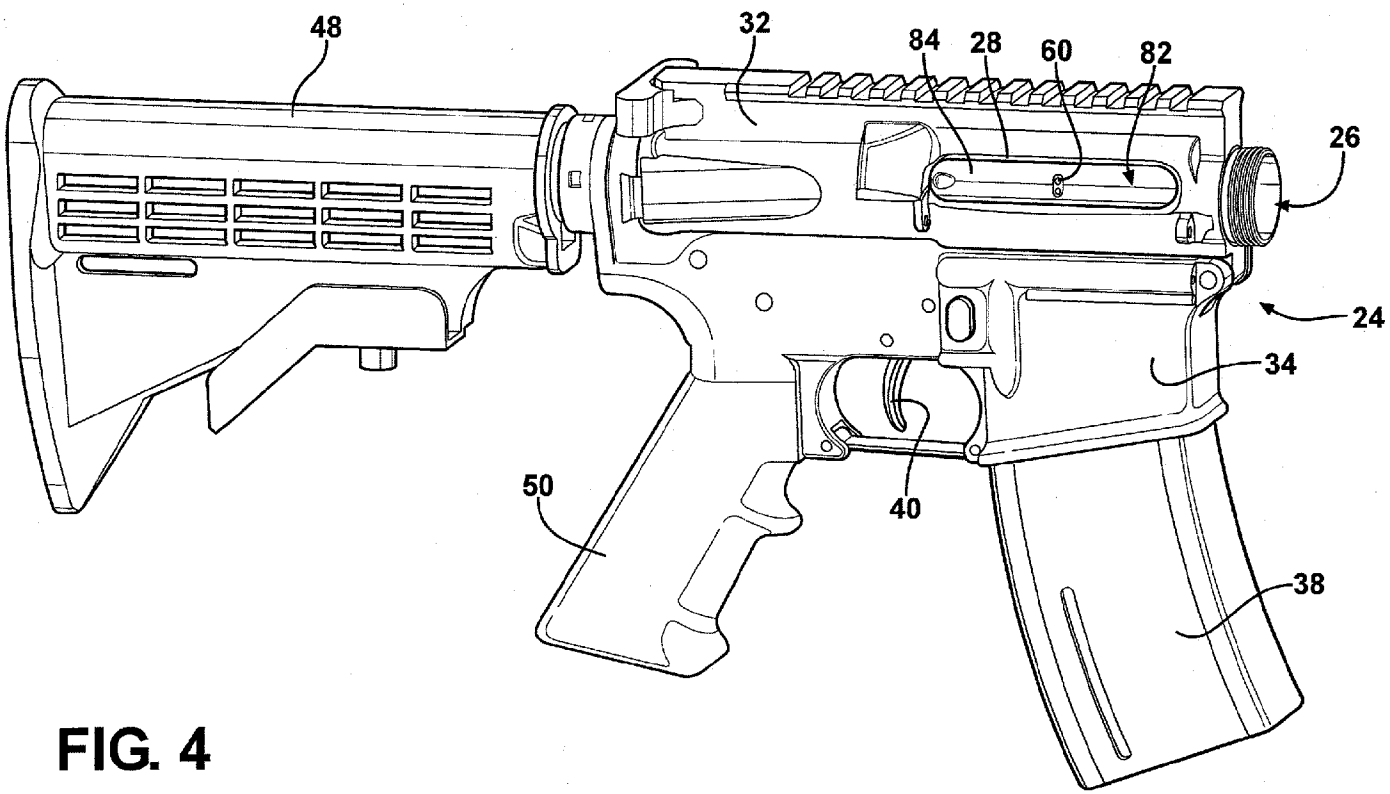
FIG. 4 is a perspective view of the firearm with certain components removed and the bolt carrier in a firing position.
Figure 5:
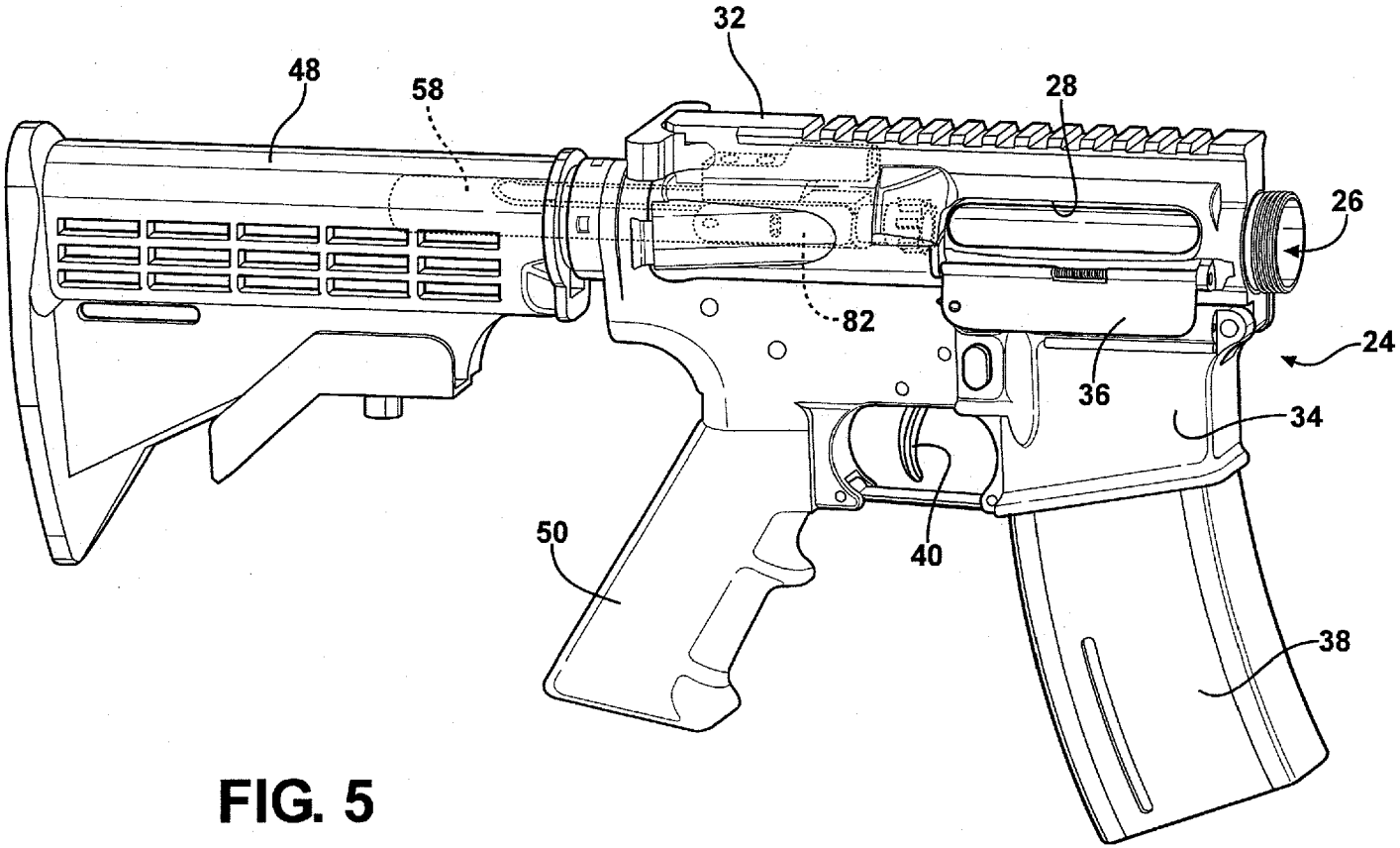
FIG. 5 is a perspective view of the firearm with certain components removed and the bolt carrier in a rearward position.
Figure 6:
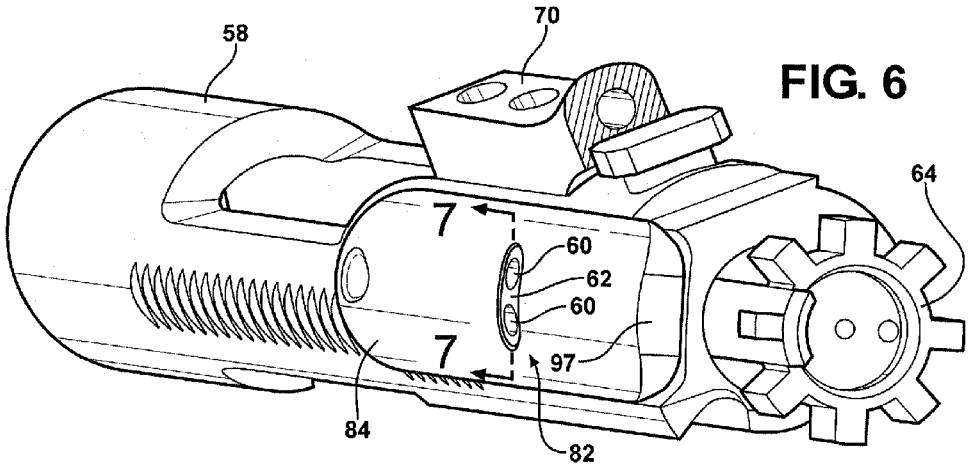
FIG. 6 is a perspective view of the bolt carrier and the shield.

As best shown in FIGS. 4 and 5, the shield 82 blocks the ejection port 28 when in the firing position and the shield 82 slides along the inner surface 30 away from the ejection port 28 when moving to the rearward position in conjunction with the bolt carrier 58. Having the shield 82 longitudinally affixed to the bolt carrier 58 provides automatic blocking of the ejection port 28 anytime the bolt carrier 58 is in the firing position without having to manually close the ejection port 28 for preventing debris from entering the ejection port 28 and fouling the firing components. The shield 82 is sized slightly larger than the ejection port 28 for continuously blocking the ejection port 28 when in the firing position to prevent debris from entering the receiver 24 and the chamber, and thus prevent fouling of the firing components. More specifically, the exterior side 84 of the shield 82 is in continuous engagement with the inner surface 30 of the receiver 24 during any movement of the bolt carrier 58.

Referring to FIGS. 2 and 4, the firing position is defined as when the bolt carrier 58 abuts the breech 54 of the barrel 46 with or without a live round disposed in the chamber of the barrel 46. Referring to FIG. 5, the rearward position is defined as when the bolt carrier 58 moves away from the breech 54 of the barrel 46. More specifically, the rearward position is further defined as when the bolt carrier 58 is spaced from the breech 54 of the barrel 46 after ejecting a spent casing and prior to catching another live round to reload into the chamber. In other words, the firing position is further defined as the middle portion 88 and the first 90 and second end portions 92 of the shield 82 completely blocking the ejection port 28 such that the bolt carrier 58 abuts the breech 54 with or without a live round disposed in the chamber and the rearward position is further defined as the middle portion 88 and the first 90 and second end portions 92 of the shield 82 being completely spaced from the ejection port 28 within the receiver 24.

A release mechanism (not numbered) may be provided between the shield 82 and the door 36 to release the door 36 from the closed position. In particular, the release mechanism would be activated when the shield 82 moves from the firing position to the rearward position for moving the door 36 from the closed position to a released position. The door 36 is spring 98 biased such that once the door 36 is in the released position, the door 36 will automatically rotate downwardly to the open position to fully open the ejection port 28. Once the door 36 is opened, the door 36 remains open until the user rotates the door 36 back to the closed position and the latch re-engages the receiver 24.

Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A firearm comprising:

a receiver defining a bore with said receiver extending along a longitudinal axis and said receiver defining an ejection port transverse to said longitudinal axis with said bore defining an inner surface;

a bolt carrier disposed in said bore and moveable relative to said receiver along said longitudinal axis between a firing position and a rearward position with said bolt carrier defining at least one exhaust port transverse to said longitudinal axis; and a shield defining an aperture aligned with said exhaust port for exhausting gases therethrough with said shield longitudinally affixed to said bolt carrier and moving with said bolt carrier as a unit between said firing and rearward positions along said longitudinal axis with said shield blocking said ejection port when in said firing position and said shield sliding along said inner surface away from said ejection port when moving to said rearward position in conjunction with said bolt carrier.

2. A firearm as set forth in claim 1 wherein said bolt carrier defines a bolt carrier recess having an outer surface for receiving said shield.

3. A firearm as set forth in claim 2 wherein said outer surface includes a distal rim extending angularly away from said longitudinal axis.

4. A firearm as set forth in claim 3 wherein said shield includes an outer edge and an angled portion tapering toward said outer edge along a part of said shield with said distal rim and said angled portion being complementary in configuration to each other.

5. A firearm as set forth in claim 2 wherein said bolt carrier further includes a boss defining a portion of said exhaust port.

6. A firearm as set forth in claim 5 wherein said boss extends outwardly from said outer surface by a first distance.

7. A firearm as set forth in claim 6 wherein said shield includes an exterior side and an interior side spaced from each other with said interior side facing said outer surface and said exterior side facing said inner surface of said receiver with said exterior side disposed a second distance from said outer surface and said second distance being greater than said first distance.

8. A firearm as set forth in claim 5 wherein said shield includes a middle portion, a first end portion 90 and a second end portion 92 with said first (90) and second end portions (92) extending outwardly from said middle portion away from each other such that said middle portion and first and second end portions are completely blocking said ejection port when in said firing position and said middle portion and said first and second end portions are completely spaced from said ejection port within said receiver when in said rearward position and wherein said middle portion of said shield defines said aperture for receiving said boss to longitudinally affix said shield to said bolt carrier.

9. A firearm as set forth in claim 1 wherein said at least one exhaust port is further defined as a plurality of exhaust ports spaced from each other and wherein said bolt carrier further includes a boss defining a portion of said plurality of exhaust ports for exhausting gases therethrough.

10. A firearm as set forth in claim 1 further including a securing system attached to one of said bolt carrier and said shield for longitudinally affixing said shield to said bolt carrier.

11. A firearm as set forth in claim 10 wherein said securing system includes a boss extending outwardly from said outer surface of said bolt carrier.

12. A firearm as set forth in claim 1 further including a biasing device disposed 2between said bolt carrier and said shield for biasing said shield outwardly away from said bolt carrier.

13. A firearm as set forth in claim 1 further including a door coupled to said receiver adjacent said ejection port with said door movable between a closed position covering said ejection port and a released position allowing said door to move away from said ejection port.

* * * * *

UNITED STATES PATENT AND TRADEMARK OFFICE

CERTIFICATE OF CORRECTION

PATENT NO. : 7,937,870 B2
APPLICATION NO. : 12/496011
DATED : May 10, 2011
INVENTOR(S) : Michael J. Brown It is certified that error appears in the above-identified patent and that said Letters Patent is hereby corrected as shown below:

Column 8, Line 2 (Claim 8) after "first end portion", please delete "90".

Column 8, Line 3 (Claim 8) after "end portion", please delete "92" and after "said first", please delete "(90)".

Column 8, Line 4 (Claim 8) before "extending", please delete "(92)".

Column 8, Line 26 (Claim 12) please delete "2between" and insert --between--.

Signed and Sealed this
Nineteenth Day of July, 2011

David J. Kappos

David J. Kappos
*Director of the United States Patent and Trademark Office*